US006624347B2

(12) United States Patent
Erismann

(10) Patent No.: US 6,624,347 B2
(45) Date of Patent: Sep. 23, 2003

(54) STRING TIGHTENING DEVICE FOR A STRING INSTRUMENT

(76) Inventor: Mark Erismann, Delfterstrasse 41, Postfach, CH-5004 Aarau (CH)

( * ) Notice: Subject to any disclaimer, the term of this patent is extended or adjusted under 35 U.S.C. 154(b) by 0 days.

(21) Appl. No.: 09/919,957

(22) Filed: Aug. 2, 2001

(65) Prior Publication Data

US 2002/0014144 A1 Feb. 7, 2002

(30) Foreign Application Priority Data

Aug. 3, 2000 (CH) ..... 1522/00
Jun. 12, 2001 (CH) ..... 1053/01

(51) Int. Cl.[7] ..... G10D 3/00
(52) U.S. Cl. ..... 84/297 R; 84/304
(58) Field of Search ..... 84/304, 305, 297 R, 84/306

(56) References Cited

U.S. PATENT DOCUMENTS 2,813,448 A 11/1957 Robinson
3,830,132 A 8/1974 Lowe
4,674,387 A * 6/1987 Caruth ..... 84/208
4,724,737 A * 2/1988 Fender ..... 84/297 R

* cited by examiner

*Primary Examiner*—Kimberly Lockett

(57) ABSTRACT

String tightening device for a string instrument having at least one string. The string tightening device includes a tuning screw arranged to be operable from a freely accessible side of the string instrument at least during play, and at least two opposing guide surfaces structured and arranged to be coupled to a body of the string instrument. A moving nut is coupled to the tuning screw and is guided between the at least two opposing guide surfaces to adjust a tension in the strings, and the moving nut includes a string connection point which is offset from the tuning screw.

28 Claims, 6 Drawing Sheets

STRING TIGHTENING DEVICE FOR A STRING INSTRUMENT

CROSS-REFERENCE TO RELATED APPLICATIONS

The present application claims priority under 35 U.S.C. §119 of Swiss Patent Application No. 2000 15522/00 filed Aug. 3, 2000 and Swiss Patent Application No. 2001 1053/01 filed June 12, 2001, the disclosures of which are expressly incorporated by reference herein in their entireties.

BACKGROUND OF THE INVENTION

1. Field of the Invention

The present invention relates to a string tightening device for a string instrument with at least one string which can be tightened by a tuning screw operable from one side of the string instrument, which is freely accessible at least during play and a moving nut for the purpose of tightening the string that is guided in a torsion-resistant manner on the tuning screw and may be shifted by rotating the tuning screw. The string is connected to the moving nut, and the connecting point of the string to the moving nut and the tuning screw is staggered, as viewed in the shifting direction of the moving nut.

2. Discussion of Background Information

A string tightening device for a string instrument of the type mentioned at the outset is known from U.S. Pat. No. 2,813,448. The present application is intended for string instruments, such as, in particular, guitars and guitar-like musical instruments. In the string tightening device according to U.S. Pat. No. 2,813,448, two plates are fastened to the body of the string instrument, parallel to the level of the tightened strings. The tuning screws, fixed to be immobile in the longitudinal direction, and the moving nut, shiftable on the tuning screws during rotation of the tuning screw are provided and, between these plates, the tuning screws can be activated from the side of the string instrument facing the tightened strings. The ends of the strings are staggered next to the tuning screws at the corresponding moving nuts. With their two end regions, the tuning screws are positioned on the plates to be immobile in the longitudinal direction. One disadvantage of this arrangement is that, in order to avoid the plates bending during tightening of the strings, the parallel plates must be embodied in a comparatively voluminous manner. In the longitudinal direction of the tuning screw, the moving nuts are guided only by guiding rods in this arrangement. The guiding rods must be fastened to the parallel plates during a special process and must be embodied as being comparatively strong and voluminous, because they are subjected to a considerable amount of stress. This arrangement requires a relatively large amount of space affecting, the overall dimensions of the string instrument and resulting in economical disadvantages. In summary, it can be stated that this arrangement requires an expensive installation, a relatively large amount of space, and is economically disadvantageous.

U.S. Pat. No. 3,830,132 shows another string tightening device having a tuning screw positioned concentrically to it, operating the moving nut that supports the end of the string. This tuning screw can only be operated from the side of the musical instrument next to the body and facing away from the tightened strings, which is troublesome for the musician, in particular when simultaneously plucking the strings. Additionally, this string tightening device is comparatively long in relation to the string tightening lift causing the space required for the guitar body to be correspondingly large.

SUMMARY OF THE INVENTION

The present invention provides a string tightening device of the type mentioned at the outset that has comparatively small dimensions, in particular with a short assembly length in relation to the string tightening lift, a simple and inexpensively produced guidance of the moving nut, and can be easy to incorporate into the body of the string instrument without any considerable weakening of the body and without any particular reinforcements, and allowing a compact construction of the string instrument.

Accordingly, the present invention provides two guide surfaces facing one another for guiding the moving nut in the direction of the tuning screw, which guide surfaces are connected to the body of the string instrument in a form-fitting manner and which compensate the stress caused by the tightened strings on the moving nut mounted for that purpose in two opposing directions. This string tightening device formed by a tuning screw and by a moving nut guided thereon in a displaceable manner is provided with comparatively small dimensions. The simple guidance of the moving nut in two parallel guide surfaces fixed to the body of the string instrument is space-saving and avoids bulky guidance devices that can be installed only with difficulty. The tightening screw is freely accessible during the tightening of the string. A reinforcement of the body of the string instrument positioned around the string tightening device is not necessary. A compact design of the string instrument is possible. Therefore, this string tightening device can be used for so-called travel guitars as well.

Advantageously, the guiding surfaces are separately positioned in a tubular case for each separate moving nut, with the tuning screw having a symmetrical axis outside of the bisecting line of the case and the moving nut being shiftable thereon in order to tighten the assigned string provided in each tubular case. This arrangement can be assembled independently of the distance between the separate strings in various string instruments. Due to the separate string tightening devices being assembled separately from one another in the body of the musical instrument, a possible interaction of the separate strings and the string tightening devices is avoided.

The case is advantageously provided with a circular cross section with the moving nut being guided in a torsion-free manner. If the cross section of the case is circular, it can be fastened in a single bore in the body of the musical instrument.

The tubular case can be provided with a cross section other than a circular one as well, with the moving nut being guided in a torsion-free manner. Such a cross section of the tubular case ensures the torsion-free guidance of the moving nut.

The tubular case can be fastened in the body of the string instrument by means of a rod that can penetrate the case and the adjacent body of the string instrument as well. The rod locks the tubular case in the body of the string instrument in an easy fashion.

Advantageously, the tapered end of the tuning screw inserts through the base cover of the case and contacts from the inside with a shoulder and is fixed therein to be immobile in the longitudinal direction by a fixing element mounted to the part of the tuning screw penetrating the base cover. It is simplest for the tuning screw to be fixed to the base cover of the case, preventing a longitudinal shifting.

Advantageously for all moving nuts positioned parallel next to one another, the guide surfaces are positioned on the inner sides of the two parallel side walls facing one another on the U-shaped profiled bar fastened on the body of the string instrument. The entire string tightening device provided with the guide surfaces can be prefabricated and built into the body of the string instrument in a simple fashion.

The guide surfaces for all moving nuts positioned next to one another can be positioned on the inner sides of two parallel and opposing side walls of a support arrangement that is provided on the body of a string instrument and that has a closed cross sectional form. A predominantly polygonal support arrangement provided with a closed shape grants the body of the string instrument a particularly good stability and supports the guide surfaces for the moving nuts as well. The support of the tuning screw in the support arrangement can easily be accomplished as well. Here, the support arrangement can be embodied in one piece or can be of several partial elements mounted on the body of the string instrument. The guide surfaces for all moving nuts positioned next to one another can also be provided on two parallel guidance plates, positioned opposite one another in the body of the string instrument, separately mounted directly to the body. These guide surfaces are integrated into the body of the musical instrument, thus facilitating the production of the musical instrument.

The moving nut can also be provided with a bore for fastening the end of the string, with the end of the string having a knot that cannot be pulled through the bore. The string is securely fastened to the moving nut by a single knot.

In order to fasten the end of the string the moving nut can be provided with a self-clamping fastening device having a pivotal lever. The self-clamping fastening of the end of the string onto the moving nut offers a simplified installation of the string.

Advantageously, the tapered end of the tuning screw penetrates a base cover of the support arrangement and contacts it from the inside at a shoulder and is fastened there to be immobile in the longitudinal direction by a fastening element mounted to the part of the tuning screw penetrating the base cover. In the simplest case, the tuning screw is held in the base cover of the case to prevent a longitudinal shifting.

Advantageously, a string guided crosswise through the case and fastened with both ends at the body of the string instrument is pulled through a traverse bore provided in the end region of the moving nut that can be ejected from the case and reinserted into the case and this string can be inserted into the case by the moving nut during tightening of the string. This arrangement is particularly suitable for a string instrument, in particular a guitar, in which the string tightening is provided from the cover side, freely accessible during play or tightening, positioned perpendicular to the longitudinal direction of the tightened string with the string tightening being opposite to the head of the string instrument. The non-centric positioning of the bisecting axis of the tuning screw in the case allows the use of the full stroke of the moving nut for tightening the string.

Advantageously, a common cover plate is provided for all tuning screws covering the string tightening device, with the cover plate being provided with an operational opening for each tuning screw. This cover improves the aesthetic impression of the musical instrument. Simultaneously, the cover plate can be provided with a guidance support acting at least perpendicularly to the longitudinal direction of the tightened strings for one end of each tuning screw. This guidance support is necessary for arrangements in which the guide surfaces for the moving nut guide only in the longitudinal direction of the tightened strings.

A tubular case can be sealed with a cover plate at the end facing the operating points of the tuning screw with the tuning screw penetrating the cover plate and a pressure coil being provided between the cover plate and the moving nut supported thereby and-the string being fed to the moving nut from the end of the case opposite to the cover plate. This arrangement is particularly suitable for guitars with the operation of the tuning screw being desired on the end of the guitar opposite to the guitar neck. The feeding of the string from the end of the case opposite to the cover plate allows the fastening of the string to the moving nut in an easily accessible point.

The present invention is directed to a string tightening device for a string instrument having at least one string. The string tightening device includes a tuning screw arranged to be operable from a freely accessible side of the string instrument at least during play, and at least two opposing guide surfaces structured and arranged to be coupled to a body of the string instrument. A moving nut is coupled to the tuning screw and is guided between the at least two opposing guide surfaces to adjust a tension in the strings, and the moving nut includes a string connection point which is offset from the tuning screw.

In accordance with a feature of the invention, the moving nut can be guided between the at least two opposing guide surfaces in a substantially torsion-free manner.

According to another feature of the present invention, the moving nut may be movable in a direction parallel to a longitudinal axis of the tuning screw. The at least two opposing guide surfaces may be coupled to the body in a form fitting manner to compensate for pressure created by tightening the string in opposing directions in the longitudinal axis direction.

The string tightening device may also include a plurality of moving nuts and a plurality of at least two opposing guide surfaces, such that each of the plurality of at least two opposing guide surfaces are associated with one of the plurality of moving nuts. A plurality of tubular cases can be fastened to the body, so that each of the plurality of tubular cases can be arranged to contain one of the at least two opposing guide surfaces and the associated moving nut. A plurality of tuning screws can also be provided so that each of the tubular cases include one of the plurality of tuning screws. In each of the plurality of tubular cases, the tuning screw may have a symmetrical axis offset from a bisecting line of the case and the moving nut can be movable along the tuning screw to adjust string tension.

At least one of the plurality of tubular cases can include a circular cross-section. Alternatively or additionally, at least one of the plurality of tubular cases may include a non-circular cross-section.

Further, a rod can be arranged to fix at least one of the plurality of tubular cases the body. The rod may be arranged to extend from within the case into the body. The tubular case may include a base cover and the tuning screw may include a tapering end arranged to penetrate through the base cover. A fixing element can be couplable to an end of the tapering end extending through the base cover. The tapering end can form a shoulder arranged to contact an inside surface of the base cover.

Moreover, the plurality of at least two opposing guide surfaces for all of the plurality of moving nuts can form parallel side walls of a U-shaped support arrangement mounted to the body.

Still further, the plurality of at least two opposing guide surfaces for all of the plurality of moving nuts can form parallel side walls of a support arrangement having a closed cross sectional shape mounted to the body. The support arrangement may be a one piece element. Alternatively, the support arrangement can include several partial elements mounted to the body.

In accordance with still another feature of the present invention, the moving nut may include a bore arranged to receive an end of the string from outside of the body and to selectively prevent removal of the end of the string from the body.

The string tightening device may further include a self-clamping device coupled to the moving nut for fastening an end of the string to the moving nut. The self-clamping fixing device can include a pivotal lever.

Moreover, the string can have two ends which are fixed to the body and the string may be guided through a case in a direction substantially perpendicular to an axial length of the case. The moving nut may be arranged for movement along the axial length of the case, and the moving nut can include an end region which is selectively within the case or outside of the case. The end region can include a bore extending substantially perpendicular to the axial length of the case.

The string tightening device can further include a cover plate provided for all tuning screws. The cover plate may include operating openings for each tuning screw. The cover plate may provide guidance support acting at least substantially perpendicular to a longitudinal direction of the tensioned string for the end of each tuning screw.

In accordance with a further feature of the instant invention, a tubular case and a cover plate can be included. The cover plate can be arranged to close one end of the tubular case, and the tuning screw may be arranged to penetrate the cover plate and a pressure spring can be provided between the cover plate and the moving nut. The string can be fed to the moving nut from an end of the case opposite the cover plate.

The present invention is directed to an apparatus for adjusting a tension in a string for a string instrument. The apparatus includes at least one tuning screw arranged to be operable from a freely accessible side of the string instrument at least during play, and at least one moving nut arrange to move along an axis of the at least one tuning screw. The moving nut may include a string connection point which is offset from the tuning screw axis.

According to a feature of the invention, a guiding device can be arranged to guide, substantially torsionally free, the moving nut along the tuning screw axis.

In accordance with yet another feature of the present invention, a support element can be included to which the tuning screw is coupled to prevent axial movement of the tuning screw.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
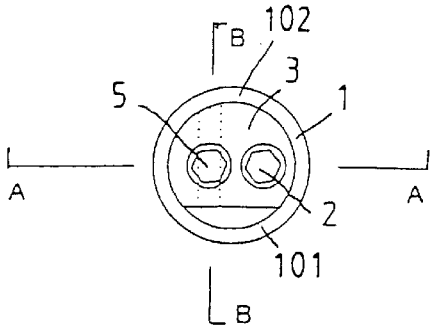
FIG. 1 illustrates a top view of a case having a built-in string tightening device with the sectional lines A—A and B—B perpendicular to A—A being marked.
Figure 2:
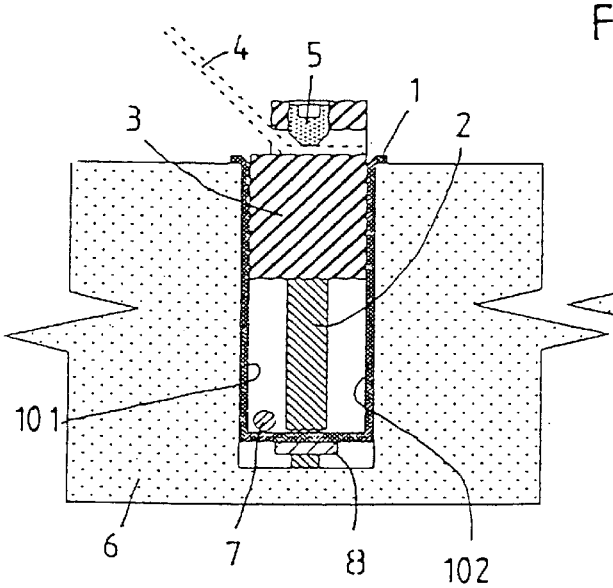
FIG. 2 illustrates a cylindrical case with a string tightening device and a clamped string end in a section B—B in accordance with FIG. 1.

FIG. 1 shows a top view of a tubular case 1 having a built-in string tightening device, for this case to be installed in the body of a string instrument, which is not shown, which case is connected in a form-fitting manner to the body 6 (FIG. 2) of the string instrument. The string instrument can be a guitar or another musical instrument provided with strings. Case 1 has the shape of a circular cylinder and comprises a string tightening device used for tuning string 4, and a tuning screw 2, and a moving nut 3, which shiftable on tuning screw 2 during tuning by rotating tuning screw 2. In the longitudinal direction of tuning screw 2, moving nut 3 is guided on the two guide surfaces 101 and 102, connected in a form fitting manner to body 6 of the string instrument. Guide surfaces 101 and 102 compensate the pressure forces in two opposite directions caused by the string tension of moving nut 3 used in normal operation. Tuning screw 2 can be operated from the freely accessible side of the string instrument during play and tuning. String 4, drawn in dot-dash lines and easily discernible in FIGS. 2 and 4, is clamped to moving nut 3 by a screw 5 discernible in FIG. 1 as well. Sectional planes A—A and B—B, marked in FIG. 1, are maintained in the description of the arrangements in the FIGS. 2 to 11.

Figure 3:
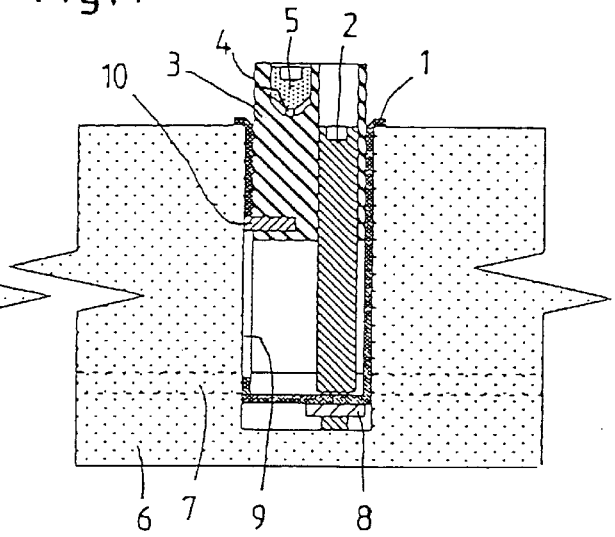
FIG. 3 illustrates the section A—A in accordance with FIG. 1.
Figure 4:
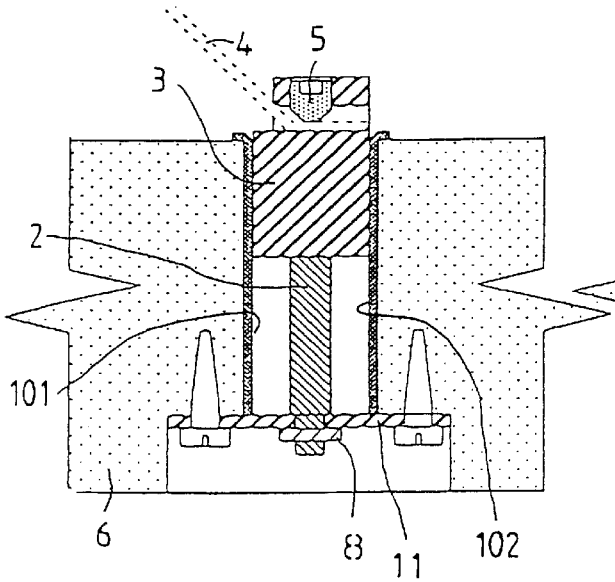
FIG. 4 illustrates a tubular case having a string tightening device with a string end clamped underneath a screw in section B—B in accordance with FIG. 1.

FIG. 2 shows a string tightening device in a section B—B and FIG. 3 in a section A—A according to the marking of the section planes in FIG. 1. It is discernible from FIGS. 2 and 3 that tubular case 1 is part of a cylinder mounted in body 6 of a string instrument positioned above the base cover. For each string 4 of the string instrument, a tubular case 1 is provided, which accepts the corresponding string tightening device. Tubular case 1 is fastened in body 6 of the string instrument by a rod 7 traversing both case 1 and adjacent body 6 of the string instrument. Tuning screw 2 is eccentrically positioned in case 1, the symmetrical axis of tuning screw 2 is positioned outside of the bisectional line. This measure allows a good use of the depth of the bore in body 6 of the string instrument provided for the tightening of string 4. Tuning screw 2 is fixed in case 1, to be immobile in the longitudinal direction. For this purpose, the tapering end of tuning screw 2, protruding through the base cover of case 1, is provided with a fixing element 8 which can be a snap ring or a splint. Tuning screw 2 rests with one shoulder on the inside of case 1. Moving nut 3 is guided on two guide surfaces 101 and 102 in case 1 and is secured against torsion by a pin 10 guided into a slot 9.

Figure 5:
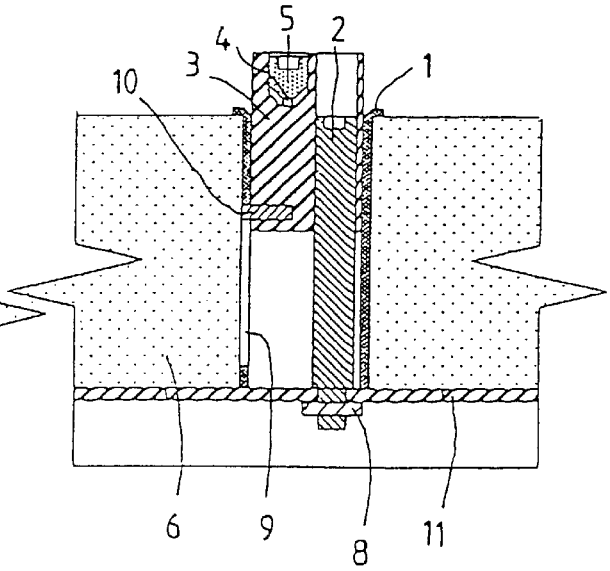
FIG. 5 illustrates a section A—A in accordance with FIG. 1.

The reference numbers selected for FIGS. 1 to 3 are maintained for identical parts in the subsequent FIGS. 2 to 11 with the designations for the identical parts being the same as well. FIG. 4 shows section B—B and FIG. 5 shows section A—A of another string tightening device. The only difference between this arrangement and those shown in FIGS. 2 and 3 is that, here, case 1 is mounted on a plate 11, with plate 11 being screwed to body 6 of the string instrument. Cases 1 provided for the separate strings 4 are mounted on a common plate 11. FIG. 5 shows plate 11 extending beyond the region of the mounting of a single case 1.

Figure 6:
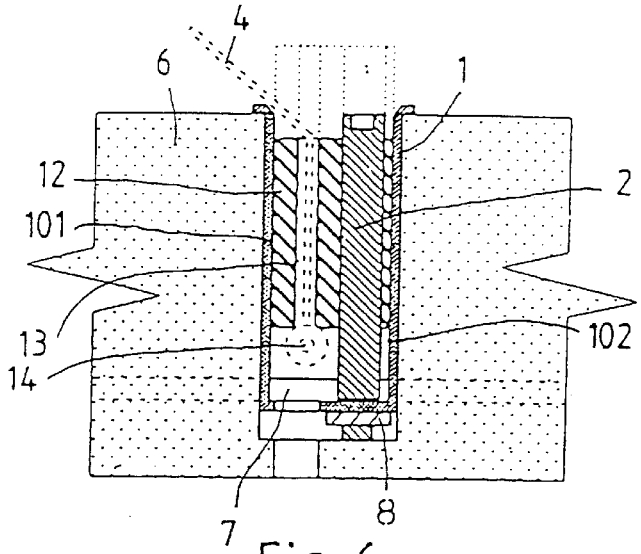
FIG. 6 illustrates a cylindrical case having a string tightening device with a bore in the moving nut and a knot at the string end in a section A—A in accordance with FIG. 1.

FIG. 6 shows another variant of the mounting of the string 4 to moving nut 12. Moving nut 12 is provided with a bore 13 for fastening the end of string 4. The end of string 4 is pierced by bore 13 and sealed with a knot 14 that cannot be pulled through bore 13.

Figure 7:
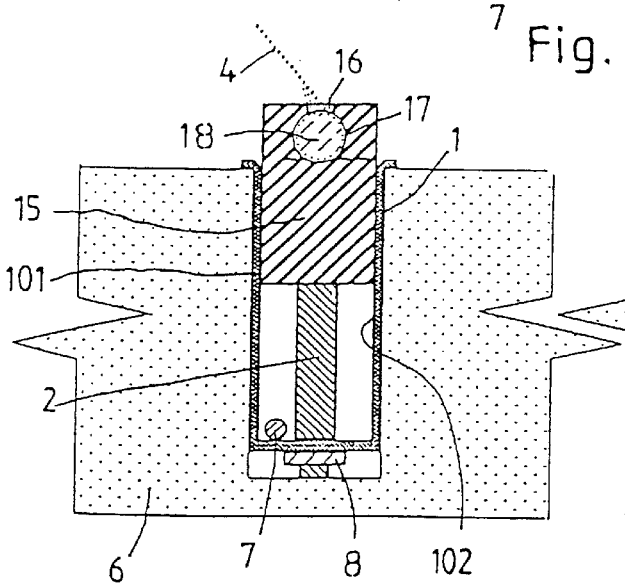
FIG. 7 illustrates a similar arrangement in a section B—B in accordance with FIG. 1.
Figure 8:
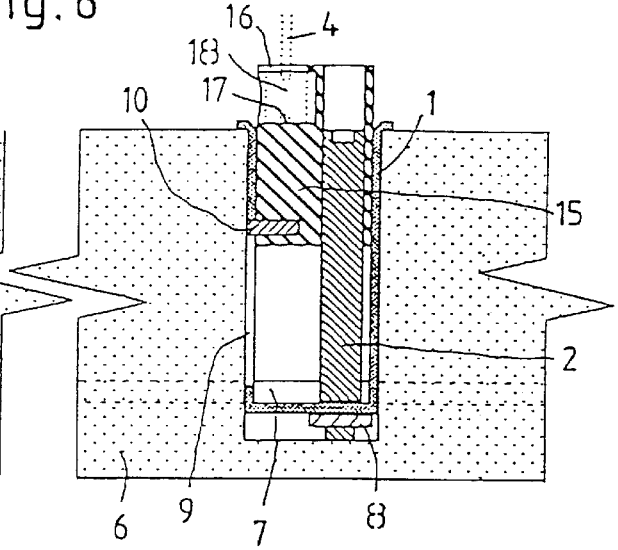
FIG. 8 illustrates a section A—A in accordance with FIG. 1.

Another type of mounting the end of string 4 to moving nut 15 is shown in FIGS. 7 and 8. On the upper end of moving nut 15, which is extendable from case 1, a bore 17 having an insertion slot 16 is provided. The axis of symmetry of bore 17 is perpendicular to the tensile direction of string 4. The end of string 4 is provided with a knot 18 fitting into bore 17.

Figure 9:
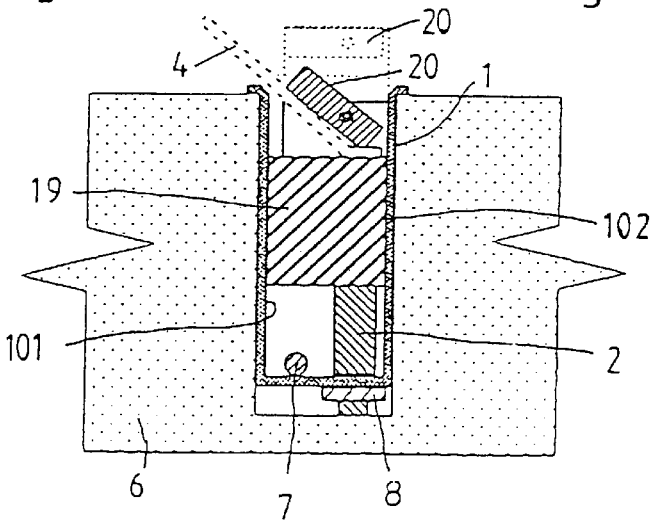
FIG. 9 illustrates a cylindrical case having a string tightening device with a self-clamping string fastening device to be operated by a lever in a section A—A in accordance with FIG. 1.

In the manner of attaching string 4 to moving nut 19, shown in FIG. 9, a pivotal lever 20 is provided at the end region of moving nut 19. String 4 passes underneath lever 20 into moving nut 19, drawn in a dot-dash line, ejected from case 1. When inserting moving nut 19, lever 20, which is supported eccentrically, pivots and clamps the end of string 4. This arrangement is self-clamping and provides an extremely simple fastening of string 4 to moving nut 19.

Figure 10:
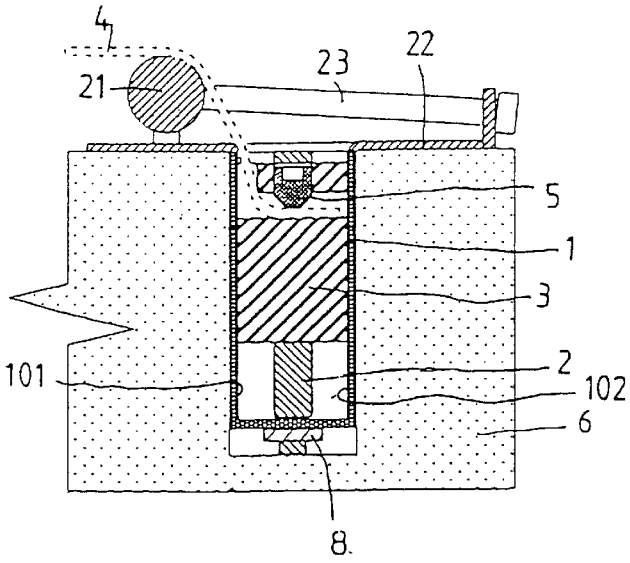
FIG. 10 illustrates a cylindrical case having a string tightening device according to FIG. 2 in combination with a shiftable string deflecting device in a section B—B in accordance with FIG. 1.
Figure 11:
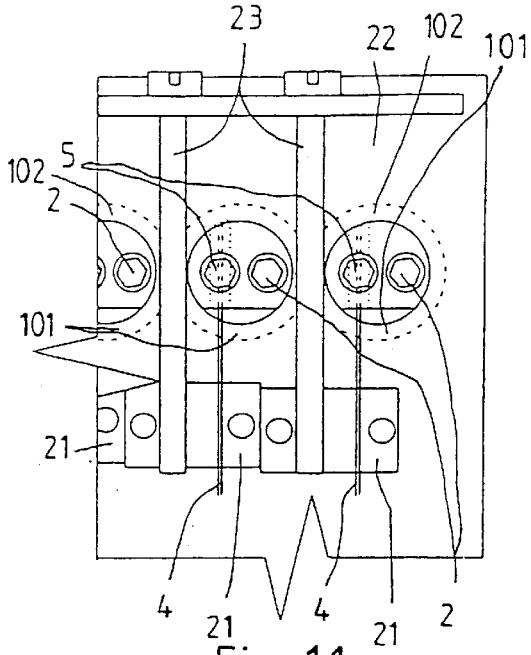
FIG. 11 illustrates the same arrangement in a top view.

In FIG. 10, a section B—B and, in FIG. 11, a top view of a string tightening device is shown, embodied according to FIGS. 2 and 3, having a case 1 inserted into the body of the string instrument in combination with a shiftable string deflection rod 21. String deflection rod 21 is supported on an installation plate 22 and can be displaced by activating screw 23 during tuning of string 4 because screw 23 ends in a threaded bore in string deflection rod 21.

Figure 12:
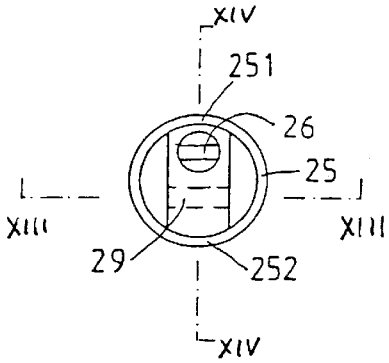
FIG. 12 illustrates a top view of a case having a built-in string tightening device indicating sections XIII—XIII and XIV—XIV for FIGS. 13 and 14.

FIG. 12 shows a top view of another string tightening device in which string 24 (see, e.g., FIG. 13) is mounted to body 6 of the string instrument with both ends and is guided in a bore 27 perpendicularly to the longitudinal direction of a tuning screw 26 positioned in a case 25. Moving nut 28 is guided on the opposing guide surfaces 251 and 252 in case 25. In FIG. 12, sectional planes XIII—XIII and XIV—XIV are marked for FIGS. 13 and 14.

Figure 13:
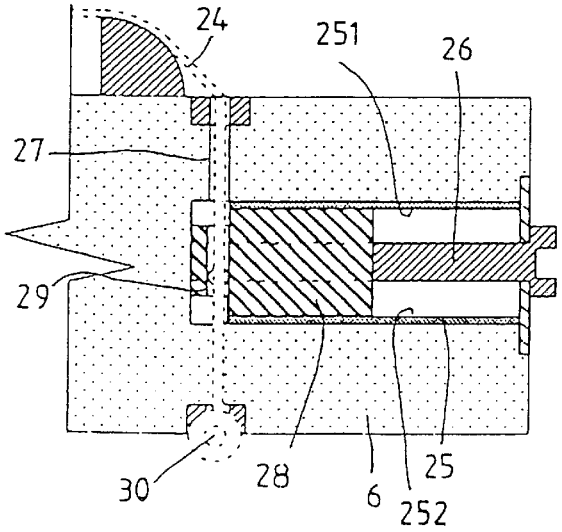
FIG. 13 illustrates the tubular case having a string tightening device having a tuning screw and a moving nut that can be inserted into the case and ejected, entraining the string, in section XIII—XIII in accordance with FIG. 12.

FIG. 13 shows the section XIII—XIII of this other string tightening device. In this figure, case 25 mounted in body 6 of the string instrument accepting the string tightening device, tuning screw 26, and moving nut 28, shiftable on tuning screw 26, are easily discernible. A bore 27 perpendicular to the median line of case 25 is mounted in body 6 of the string instrument. String 24, mounted to body 6 of the string instrument with both ends, passes through this bore 27 and entraining channel 29 mounted to the end of moving nut 28. When activating tuning screw 26, moving nut 28 is pulled into case 25. Together with moving nut 28, the part of string 24 positioned in entraining channel 29 is pulled into case 25 as well and, in this manner, string 24 is tightened. One end of string 24 is held in the part of the string instrument that is not shown and the other end by a knot 30 that cannot be pulled through bore 27. This arrangement is particularly suitable for string instruments having a surface for accessing tuning screw 26 provided perpendicularly to the longitudinal direction of strings 24. The slot provided at the accessible end of tuning screw 26 can be activated using by a metal coin. When entraining channel 29 is provided on the upper part of moving nut 28, string 24 guided in moving nut 28 is not pulled into case 25, but rather pushed in.

Figure 14:
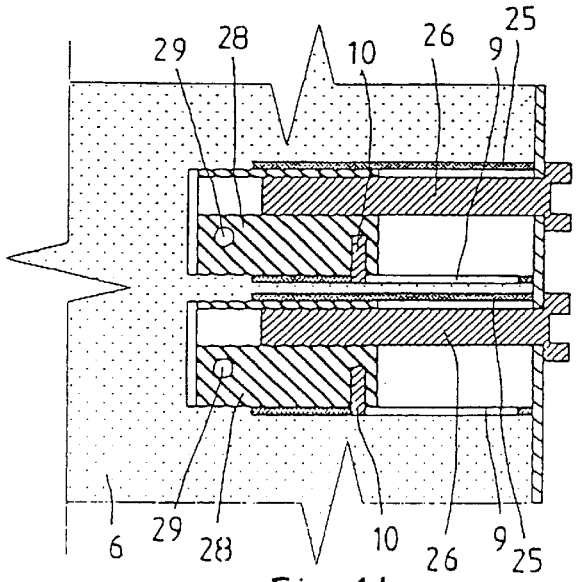
FIG. 14 illustrates two cases positioned next to one another in accordance with FIG. 13 in a section XIV—XIV in accordance with FIG. 12.

FIG. 14 shows a section XIV—XIV of the string tightening device shown in FIG. 13 having two cases 25 positioned next to one another. The number of cases 25 to be positioned next to one another depends on the embodiment of the string instrument. In a guitar, for example, 6 cases arranged next to one another are generally necessary because a guitar is generally stringed with 6 strings.

Figure 15:
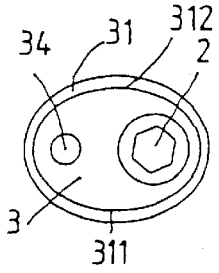
FIG. 15 illustrates the top view of an oval case.

FIG. 15 shows another case 31 provided with an oval shape and having a built-in tuning mechanism and a cover. The cover is embodied similarly to the one shown in FIG. 18, but only provided for one case 31. Here, tuning screw 2 serves to activate moving nut 3, shown in FIGS. 1 to 11 as well, with moving nut 3 being provided with an oval cross sectional shape, adjusted to case 31. A string, which is not shown, is fed through a string feeding opening 34 to moving nut 3 positioned underneath. The two opposing guide surfaces 311 and 312 are positioned on the curved inner surface of case 31.

Figure 16:
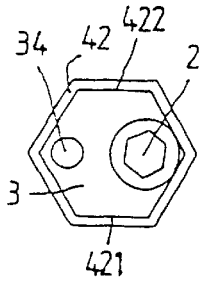
FIG. 16 illustrates the top view of a hexagonal case.

FIG. 16 shows a tightening mechanism positioned in a hexagonal case 42 having a cover provided for case 42 only. The two opposing guide surfaces 421 and 422 guide moving nut 3 in case 42 with moving nut 3 having a hexagonal cross sectional shape adapted to case 42. Tuning screw 2 and string feeding opening 34 are embodied similarly as described above using FIG. 15.

Figure 17:
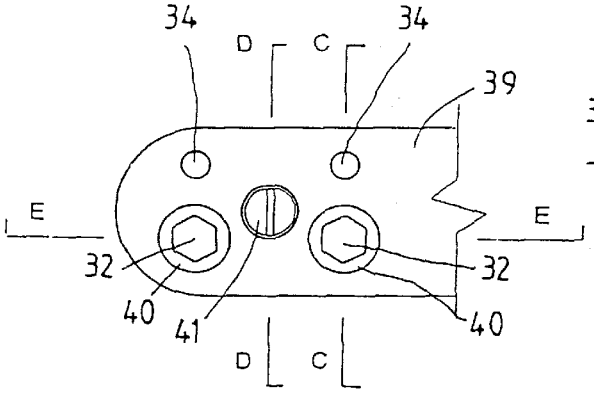
FIG. 17 illustrates the top view of a cover plate with the sections C—C, D—D, and E—E being marked.
Figure 18:
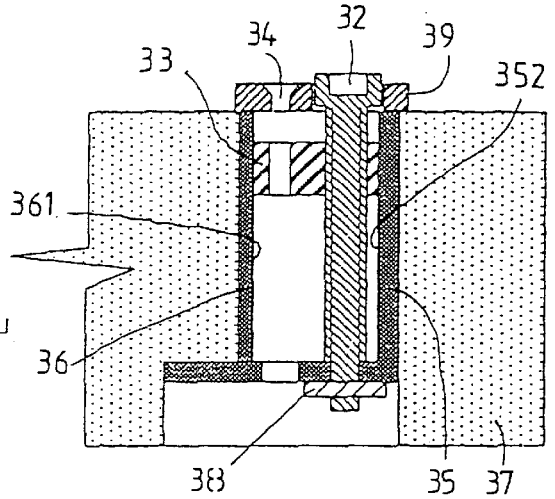
FIG. 18 illustrates a support arrangement comprising angular and flat profiled bars in a section C—C in accordance with FIG. 17.
Figure 19:
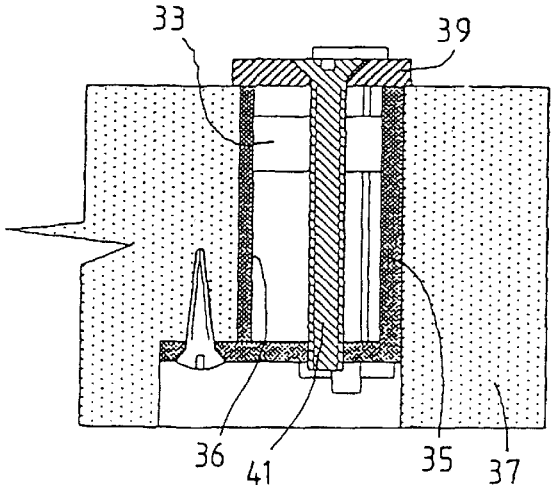
FIG. 19 illustrates a section D—D in accordance with FIG. 17.

FIGS. 17 to 26 show a string tightening device in which all tuning screws 32 positioned next to one another are positioned together with the corresponding moving nuts 33 in a common support arrangement extending perpendicularly to the longitudinal direction of the tightened strings. FIG. 17 shows part of a cover 39 with the sectional planes C—C, D—D, and E—E being marked for FIGS. 18 to 24. Cover plate 39 is provided for a support arrangement having tightening mechanisms positioned next to one another. An operation opening 40 is provided for each tuning screw 32 in cover plate 39 and a string feeding opening 34 for each string. Advantageously, these openings are covered with a coating made of a wear-resistant material. Cover plate 39 is mounted to the angled profiled bar 35 by screws 41, as can be seen in FIG. 19 in section D—D.

FIG. 18 shows a section C—C according to FIG. 17. Opposing guide surfaces 352 and 361 are positioned on the inside of a U-shaped support arrangement comprising an angled profiled bar 35 and a flat profiled bar 36 as shown in FIG. 18. Angled profiled bar 35 and flat profiled bar 36 are mounted to body 37 of the string instrument. The tapering end of tuning screw 32 is guided through a bore in angled profiled bar 35 and held therein to be immobile in the longitudinal direction by a fixing element 38. Tuning screw 32 rests with one shoulder at the edge of the bore on angled profiled bar 35. The U-shaped support arrangement shown in FIG. 18 is open at the side facing the plane of the strings, which is not shown. The string tightening devices positioned next to one another are covered with a cover plate 39.

Figure 20:
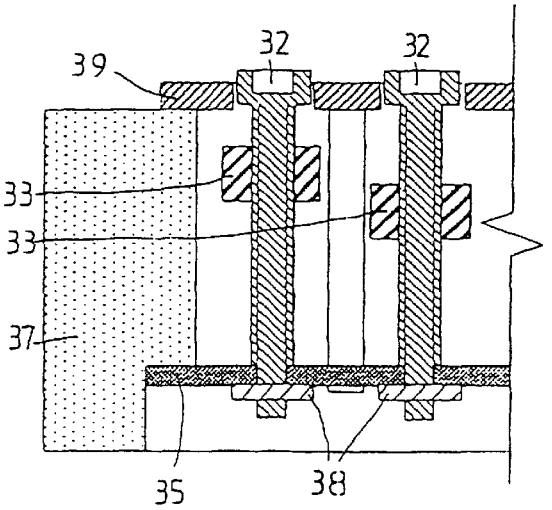
FIG. 20 illustrates a string tightening device in a section E—E in accordance with FIG. 17.

FIG. 20 shows a section E—E according to FIG. 17. Here, two tuning screws 32 positioned next to one another and sealed with the fixing elements 38, with moving nuts 33 being discernibly shiftable on these screws. The parts described above using FIGS. 17 to 19 are used here with the reference numbers given above.

Figure 21:
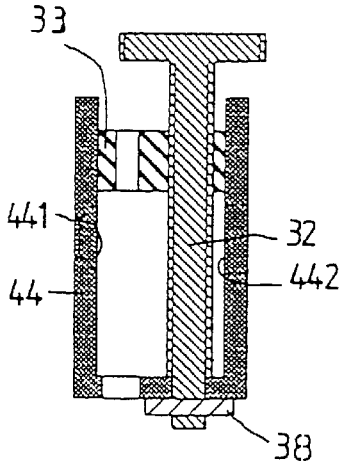
FIG. 21 illustrates a support arrangement comprising a U-profiled bar in a section C—C in accordance with FIG. 17.
Figure 22:
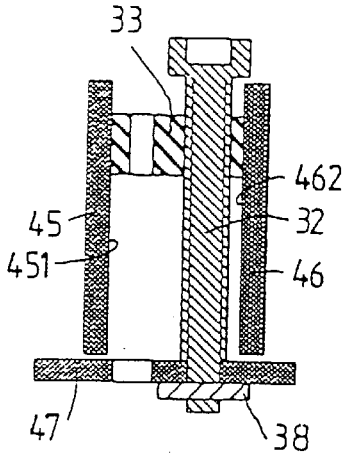
FIG. 22 illustrates a support arrangement comprising flat profiled bars in a section C—C in accordance with FIG. 17.

Two other support arrangements are shown in a section C—C in FIGS. 21 and 22. In FIG. 21, the string tightening device, which comprises tuning screw 32, provided with a knurled head, and moving nut 33, is positioned in a U-profiled bar 44 mounted inside body 37 of the string instrument. Guide surfaces 441 and 442 for moving nut 33 are positioned on the inside of U-profiled bar 44. The support arrangement shown in a section C—C in FIG. 22 comprises three flat profiled bar sections 45, 46, and 47 mounted to body 37 of the string instrument. Guide surfaces 451 and 462 for moving nut 33 are positioned on the inside of flat profiled bar sections 45 and 46.

Figure 23:
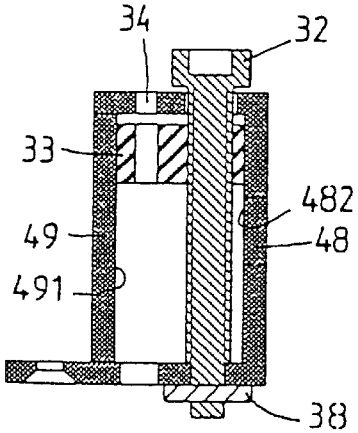
FIG. 23 illustrates a support arrangement comprising a U-profiled bar and a flat profiled bar in a section C—C in accordance with FIG. 17.
Figure 24:
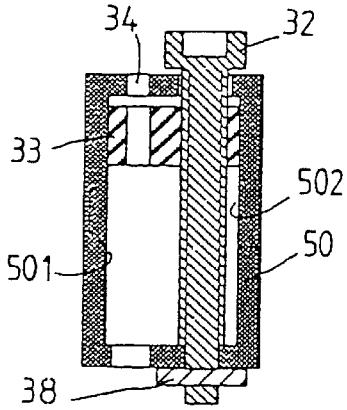
FIG. 24 illustrates a support arrangement comprising a closed squared profiled bar in a section C—C according to FIG. 17.

FIGS. 23 and 24 show support arrangements having a closed cross sectional shape. In FIG. 23, the closed shape comprises a horizontal U-profiled bar 48 and a flat profiled bar 49 mounted in body 37 of the string instrument. Opposing guide surfaces 482 and 491 are positioned on the inner sides of flat profiled bars 49 and U-profiled bar 48. In FIG. 24, a closed shape is provided by a square profile 50 mounted to body 37 of the string instrument. In this arrangement, opposing guide surfaces 501 and 502 are positioned on the two opposing inner sides of square profile 50. A cover is not necessarily required in these two arrangements because tuning screw 32 is guided in the support arrangement.

Figure 25:
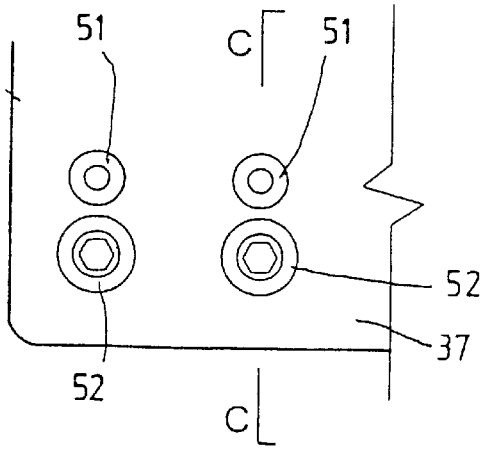
FIG. 25 illustrates a top view of a section of the surface of the string instrument with the section C—C marked.
Figure 26:
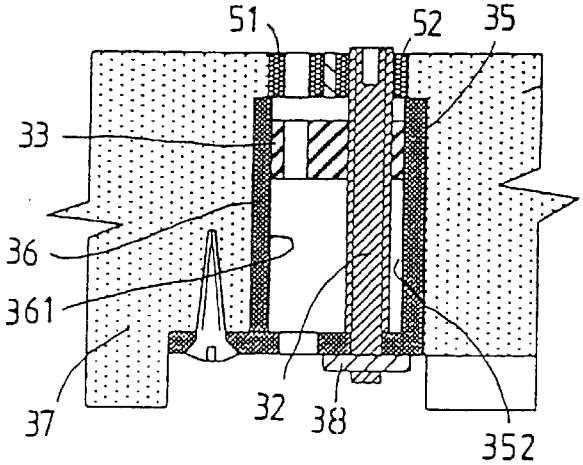
FIG. 26 illustrates a support arrangement comprising angular and flat profiled rods in a section in accordance with FIG. 25.

FIG. 25 shows a top view of the surface of the string instrument. Body 37 supports one string guidance case 51 each, recessed into body 37, for each string tightening device and a guidance case 52, also recessed into body 37, for tuning screw 32, as shown in a section in FIG. 26 as well. In this arrangement, a cover plate, shown in FIG. 17, may be omitted as well, because the tuning screw is guided directly in guidance case 52 in body 37 of the string instrument. Guide surfaces 352 and 361 are positioned on the inner surfaces of flat profiled bar 36 and angled profiled bar 35 facing one another, which form the borders of the U-shaped support arrangement.

Figure 27:
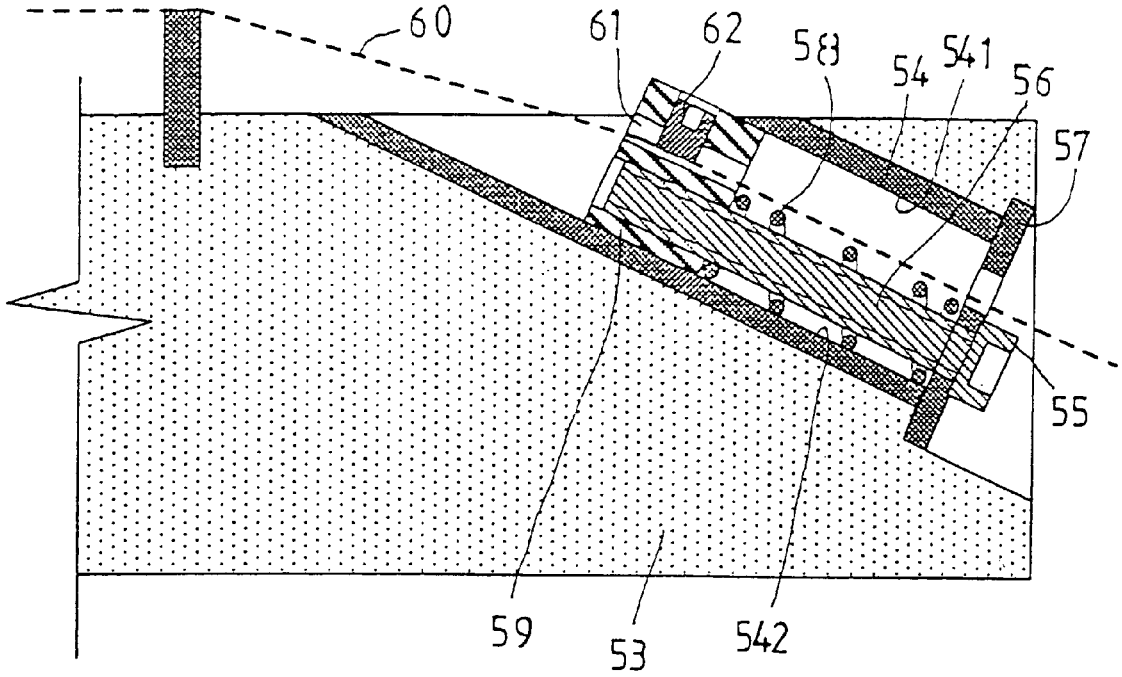
FIG. 27 illustrates a string tightening device having a case including a tightening screw and a moving nut, being diagonally positioned with respect to the surface of the musical instrument.

FIG. 27 shows another variant embodiment of the string tightening device having a tubular case 54 mounted in body 53 of the string instrument, are diagonally arranged to-the plane of the tightened strings. Case 54 is sealed at the end supporting operating point 55 of tuning screw 56 with cover plate 57. Operating point 55 of pressure spring 58 is supported on cover plate 57. Pressure spring 58 is provided on the side of cover plate 57 facing case 54, this spring being supported on cover plate 57 and on moving nut 59. Pressure spring 58 fixes moving nut 59 to the selected point in case 54. A bore 61 for accepting string 60 to be tightened is provided at moving nut 59. String 60 guided through bore 61 is fixed to moving nut 59 by an easily accessible screw. When tightening the string 60, tuning screw 56 is rotated and, thus, moving nut 59 with string 60 fixed thereto is shifted against the force of pressure spring 58. Guide surfaces 541 and 542 provided for moving nut 59 are positioned on the inner surface of case 54. It is discernible from FIG. 27 that string 60 is fed from the end opposite case 54 of moving nut 59. This arrangement of a string tightening device is particularly advantageous for guitars in which the operation of the string tightening is desired on the end of the guitar opposite to the neck of the guitar.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended-claims.

What is claimed:

1. A string tightening device for a string instrument having at least one string comprising:

a tuning screw arranged to be operable from a freely accessible side of the string instrument;

at least two opposing guide surfaces being structured and arranged to be coupled to a body of the string instrument;

a moving nut being coupled to said tuning screw and being guided between said at least two opposing guide surfaces to adjust a tension in the strings; and said moving nut comprising a string connection point which is offset from said tuning screw.

2. The string tightening device in accordance with claim 1, wherein said moving nut is guided between said at least two opposing guide surfaces in a substantially torsion-free manner.

3. The string tightening device in accordance with claim 1, wherein said moving nut is movable in a direction parallel to a longitudinal axis of the tuning screw, and wherein said at least two opposing guide surfaces are coupled to said body in a form fitting manner to compensate for pressure created by tightening the string in opposing directions in the longitudinal axis direction.

4. A string tightening device for a string instrument having at least one string comprising:

a tuning screw arranged to be operable from a freely accessible side of the string instrument;

at least two opposing guide surfaces being structured and arranged to be coupled to a body of the string instrument;

a moving nut being coupled to said tuning screw and being guided between said at least two opposing guide surfaces to adjust a tension in the strings;

said moving nut comprising a string connection point which is offset from said tuning screw; and a plurality of moving nuts and a plurality of at least two opposing guide surfaces, such that each of said plurality of at least two opposing guide surfaces are associated with one of said plurality of moving nuts.

5. The string tightening device in accordance with claim 4, further comprising:

a plurality of tubular cases fastened to said body, wherein each of said plurality of tubular cases are arranged to contain one of said at least two opposing guide surfaces and said associated moving nut; and a plurality of tuning screws, wherein each of said tubular cases include one of said plurality of tuning screws.

6. The string tightening device in accordance with claim 5, wherein in each of said plurality of tubular cases, said tuning screw has a symmetrical axis offset from a bisecting line of said case and said moving nut is movable along said tuning screw to adjust string tension.

7. The string tightening device in accordance with claim 5, wherein at least one of said plurality of tubular cases comprises a circular cross-section.

8. The string tightening device in accordance with claim 5, wherein at least one of said plurality of tubular cases comprises a non-circular cross-section.

9. The string tightening device in accordance with claim 5, further comprising a rod arranged to fix at least one of said plurality of tubular cases the body.

10. The string tightening device in accordance with claim 5, wherein said rod is arranged to extend from within said case into the body.

11. The string tightening device in accordance with claim 5, wherein said tubular case comprises a base cover and said tuning screw comprises a tapering end arranged to penetrate through said base cover, and wherein a fixing element is couplable to an end of said tapering end extending through said base cover.

12. The string tightening device in accordance with claim 11, wherein said tapering end forms a shoulder arranged to contact an inside surface of said base cover.

13. The string tightening device in accordance with claim 4, wherein said plurality of at least two opposing guide surfaces for all of said plurality of moving nuts form parallel side walls of a U-shaped support arrangement mounted to the body.

14. The string tightening device in accordance with claim 4, wherein said plurality of at least two opposing guide surfaces for all of said plurality of moving nuts form parallel side walls of a support arrangement having a closed cross sectional shape mounted to the body.

15. The string tightening device in accordance with claim 14, wherein said support arrangement is a one piece element.

16. The string tightening device in accordance with claim 14, wherein said support arrangement comprises several partial elements mounted to the body.

17. The string tightening device in accordance with claim 1, wherein said moving nut comprises a bore arranged to receive an end of said string from outside of said body and to selectively prevent removal of the end of the string from said body.

18. The string tightening device in accordance with claim 1, further comprising a self-clamping device coupled to said moving nut for fastening an end of the string to said moving nut.

19. The string tightening device in accordance with claim 18, wherein said self-clamping fixing device comprises a pivotal lever.

20. The string tightening device in accordance with claim 1, further comprising a case structured to contain said tuning screw and said moving nut, said case being arranged such that the string is guided through said case and said moving nut in a direction substantially perpendicular to an axial length of said tuning screw.

21. The string tightening device in accordance with claim 1, wherein the string has two ends which are fixed to the body and the string is guided through a case in a direction substantially perpendicular to an axial length of said case, wherein said moving nut is arranged for movement along the axial length of said case, and said moving nut comprises an end region which is selectively within said case or outside of said case, said end region comprising a bore extending substantially perpendicular to the axial length of said case.

22. The string tightening device in accordance with claim 1, further comprising a cover plate provided for all tuning screws, wherein said cover plate comprises operating openings for each tuning screw.

23. The string tightening device in accordance with claim 22, wherein said cover plate provides a guidance support acting at least substantially perpendicular to a longitudinal direction of the tensioned string for the end of each tuning screw.

24. The string tightening device in accordance with claim 1, further comprising a tubular case and a cover plate, said cover plate being arranged to close one end of said tubular case, wherein said tuning screw is arranged to penetrate said cover plate and a pressure spring is provided between said cover plate and said moving nut.

25. The string tightening device in accordance with claim 24, wherein the string is fed to said moving nut from an end of said case opposite said cover plate.

26. An apparatus for adjusting a tension in a string for a string instrument comprising:

at least one tuning screw arranged to be operable from a freely accessible side of the string instrument;

at least one moving nut arrange to move along an axis of said at least one tuning screw; and said moving nut comprising a string connection point which is offset from said tuning screw axis.

27. The apparatus in accordance with claim 26, further comprising a guiding device arranged to guide, substantially torsionally free, said moving nut along said tuning screw axis.

28. The apparatus in accordance with claim 26, farther comprising a support element to which said tuning screw is coupled to prevent axial movement of said tuning screw.

* * * * *